US005611720A

United States Patent [19]

Vandermaas

[11] Patent Number: 5,611,720

[45] Date of Patent: Mar. 18, 1997

[54] FLYING DISC TOY WITH LIGHTING SYSTEM

[75] Inventor: John Vandermaas, Calgary, Canada

[73] Assignee: Alien Warper, Inc., Calgary, Canada

[21] Appl. No.: 604,010

[22] Filed: Feb. 20, 1996

[51] Int. Cl.[6] ..... A63B 65/10

[52] U.S. Cl. ..... 446/47; 446/485; 473/570

[58] Field of Search ..... 446/34, 46, 47, 446/48, 485; 273/424, 425, 428

[56] References Cited

U.S. PATENT DOCUMENTS

| | | | |
|---|---|---|---|
| 3,610,916 | 10/1971 | Meehan | 446/485 |
| 3,812,614 | 5/1974 | Harrington | 46/228 |
| 3,935,669 | 2/1976 | Potrzuski et al. | 446/485 |
| 3,948,523 | 4/1976 | Michael | 446/47 |
| 4,301,616 | 11/1981 | Gudgel | 46/228 |
| 4,307,538 | 12/1981 | Moffitt | 46/228 |
| 4,563,160 | 1/1986 | Lee | 446/47 |
| 4,748,366 | 5/1988 | Taylor | 310/328 |
| 4,778,428 | 10/1988 | Wield | 446/47 |
| 4,848,009 | 7/1989 | Rodgers | 36/137 |
| 4,869,699 | 9/1989 | Plambeck | 446/46 |
| 4,929,212 | 5/1990 | Li | 446/47 |
| 5,032,098 | 7/1991 | Balogh et al. | 446/47 |
| 5,083,799 | 1/1992 | Thill | 273/424 |
| 5,319,531 | 6/1994 | Kutnyak | 362/184 |

*Primary Examiner*—Robert A. Hafer
*Assistant Examiner*—Jeffrey D. Carlson
*Attorney, Agent, or Firm*—David S. Thompson

[57] ABSTRACT

A flying disc toy of the FRISBEE® type provides a lighting system having LEDs used in conjunction with a glow-in-the-dark body. The flying disc provides a raised center section having a plurality of LEDs mounted radially at spaced intervals. A motion responsive switch is used to turn on the LEDs in response to movement of the disc. Electronic circuitry controlling the LEDs provides a timer circuit that automatically turns off the LEDs a timed period after they are turned on. As a result of the motion sensitive switch and timer circuit, the lights flash on and off rapidly as the disc flies through air turbulence. No on-off switch is required, since the circuitry rapidly turns itself off. Because no on-off switch is present, all components are carried in a waterproof raised center section having no opening. An optional battery plug structure is threadedly insertable into a plug receiver in the raised center section, and allows the user to replace the battery.

7 Claims, 3 Drawing Sheets

FLYING DISC TOY WITH LIGHTING SYSTEM

CROSS-REFERENCES

There are no applications related to this application filed in this or any foreign country.

BACKGROUND

Following the invention of the FRISBEE® flying disc toy, a number of inventors have attempted to improve the FRISBEE® and similar flying discs by adding lighting systems that improve both the appearance and the utility of the flying disc. A lighted disc is usable in the evening hours when a non-lighted disc is not usable. Moreover, a light disc provides an added level of entertainment, based in part on novelty, that non-lighted discs fail to offer.

Several systems have been used in the past to illuminate flying discs. One of the earliest systems was to use glow-in-the-dark materials to construct the flying disc. Such materials could either be integrated into the structure of the disc, or could be added by means of special coating materials. Typically the result was a disc that produced a desirable eerie glow at night, but was often ineffective during the twilight hours due to the relatively high ambient light level. Moreover, the glow frequently did not last long, and many discs required frequent recharging by direct exposure to a strong light source.

Later systems used light emitting diodes (LEDs) as a light source, powered by small low voltage batteries. In part for reasons of esthetics, and in part to conserve battery power, a few flying discs have provided circuitry to apply a square wave or similar cyclic voltage to the LEDs. This type of circuitry has included timer circuits and oscillators formed from NOR or NAND gates. Unfortunately, the regular pulsations of the LED light sources are not in any way controllable by the user. Moreover, the LEDs must be turned on prior to use, and off after use, making such toys usable only by older children.

Some attempt has been made to provide a flying disc toy with an on-board switch that turns power on only when the disc is in use. An example of such a switching structure provides a pair of centrifugally-activated electrical switches. Although bulky and heavy, these switches address the issue of automatically turning power off, but do not address the issue of activating the LEDs in response to the movement of the disc in flight. Also, by virtue of their mass, these switches tend to alter the flight characteristics of the disc.

What is needed is a flying disc toy that provides both LED lighting that flashes on in response to movement of the disc, and off in response to a timer circuit, as well as glow-in-the-dark structures. The disc toy must turn its electronic circuitry off automatically when not in use, so as to prevent unwanted battery drain. The flying disc toy must also provide a raised center section that has a waterproof storage area for all the needed electronic circuitry.

SUMMARY

The present invention is directed to an apparatus that satisfies the above needs. A novel flying disc toy is provided that provides both glow-in-the-dark structures as well as LED lighting that flashes on in response to movement of the disc, and off in response to a timer circuit.

The flying disc toy of the present invention provides:

(a) A substantially disc shaped body terminating at its periphery in a downwardly extending rim. The body and the rim define a substantially convex upper surface and a substantially concave lower surface.

(b) Glow-in-the-dark or chemiluminescent substance, integrated into the body or applied as a coating to the surface of the body, allowing the disc to provide illumination, particularly in a downward direction.

(c) A raised center section, supported by the upper surface of the body. The center section provides an annular sidewall and a roof, and together with the convex upper surface of the body, defines an interior cavity that is generally waterproof.

(d) A plurality of LEDs, mounted at spaced intervals about the annular sidewall of the raised center section, and connected electrically to a circuit board.

(e) A circuit board, housed in the interior cavity and typically supported by short legs, mounted on the upper convex surface of the body that provides the following:

(a) An activation switch that is sensitive to the motion of the flying disc. Typically, the switch will take the form of a mercury switch, having two electrical contacts that are momentarily electrically connected by movement of a mercury globule in a container having two electrical terminals.

(b) A monostable multivibrator integrated circuit (IC). This IC functions to provide a first output signal, upon receipt of an input signal resulting from the closure of the activation switch, causing the LEDs to light. In a period of time determined by the values of a capacitor and a resistor attached to the IC, a second output signal is provided, turning the LEDs off. This period of time is usually chosen to be quite short, such as a small fraction of a second.

(c) A transistor, having its base connected to the IC, receives the first and second output signals from the IC. Upon receipt of the first signal, the transistor turns on, allowing current to pass, causing the LEDs to operate. Upon receipt of the second signal, the transistor turns off, preventing current passage, causing the LEDs to turn off.

(d) A battery, carried by a battery holder, typically providing a potential of about 3 V dc, delivers power to the IC and the LEDs.

A more detailed description of one version of the invention includes the following:

(a) A removable battery plug, carrying the battery holder and battery, that is threadedly installed into a plug receiver that is part of the body of the disc.

It is therefore a primary advantage of the present invention to provide a novel flying disc toy that provides the advantages of both glow-in-the-dark structures as well as LED lighting.

Another advantage of the present invention is to provide a battery plug, carrying a battery holder and battery, that may be installed into a plug receiver mounted on the body of the flying disc.

Another advantage of the present invention is to provide an electronic circuit driving the LEDs that turns itself off, and therefore requires no on-off switch.

A still further advantage of the present invention is to provide an electronic circuit driving the LEDs that is responsive to the movement of the disc.

A still further advantage of the present invention is to provide a flying disc toy that provides a raised center portion having a waterproof area that houses the electronic circuitry that is required.

DRAWINGS

These and other features, aspects, and advantages of the present invention will become better understood with regard to the following description, appended claims, and accompanying drawings where:

DESCRIPTION

Figure 1:
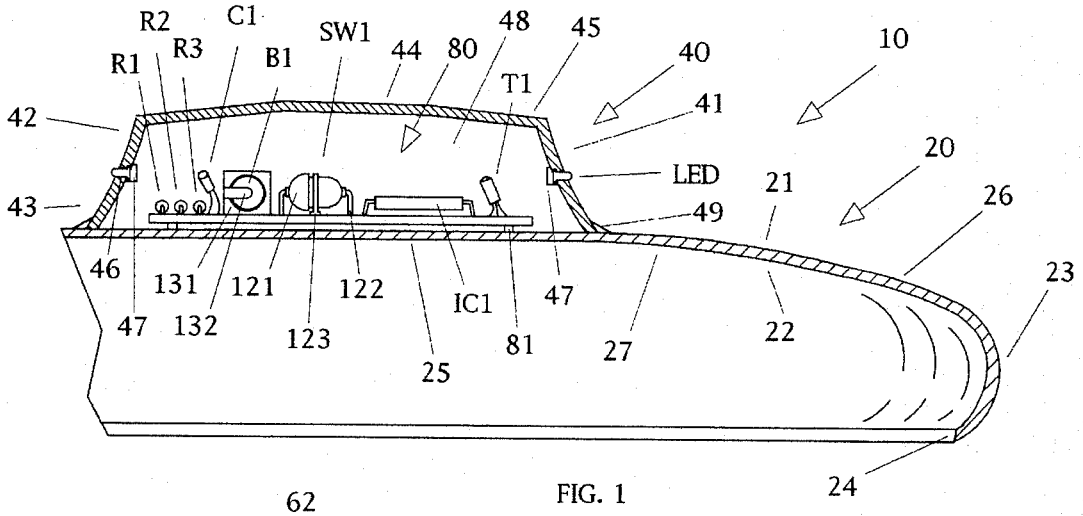
FIG. 1 is a side cross-sectional view of a version of the flying disc of the invention, showing the disc body, raised center section, circuit board, and two of the LEDs.
Figure 2:
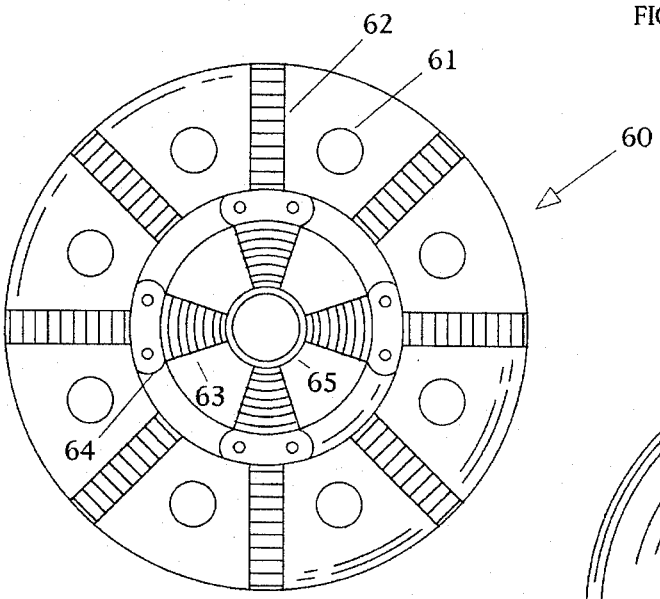
FIG. 2 is a top view of the flying disc of FIG. 1, showing the positioning of the LEDs on the outside of the raised center section and showing decorative body designs.
Figure 3:
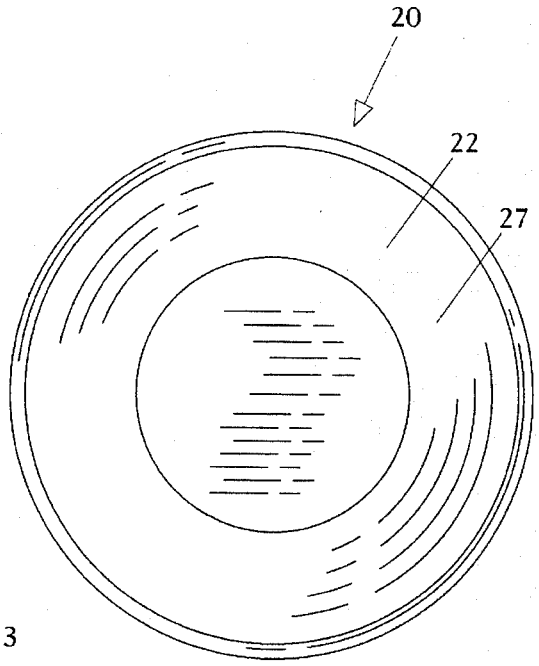
FIG. 3 is a bottom view of the flying disc of FIG. 1, showing the area of glow-in-the-dark material.

Referring in particular to FIGS. 1–3, a flying disc toy 10 constructed in accordance with the principles of the invention is seen. The disc 10 provides a disc body 20 that is generally consistent with most of the popular flying discs sold on the market, including the disc sold by Wham-O Products under the name FRISBEE®. As seen in FIG. 2, the upper portion of the disc body 20 is covered with a decorative design 60 in the preferred embodiment. A raised center section 40 is seen particularly in the cross-sectional view of FIG. 1, having plurality of light emitting diodes (LEDs) mounted about its annular sidewall 41. The raised center section provides an interior cavity 48 housing the circuit board 80, which contains the electronics necessary to turn the LEDs on in response to a motion sensitive switch SW1, and off a timed period later.

As seen in FIGS. 1–3, the disc body 20 provides a substantially disc shaped body terminating in its periphery in a downwardly extending rim 24. An annular leading edge 23 is best seen in FIG. 1. The body 20 and the rim 24 define a substantially convex upper surface 21 and a substantially concave lower surface 22. A center portion 25 is substantially flat, while a sloping outer portion 26 slants downwardly.

In the preferred embodiment, a chemiluminescent coating 27 is applied to the lower surface 22 of the disc body 20, causing the disc to be luminescent, particularly when seen from below. In an alternative embodiment, the chemiluminescent coating 27 may also be applied to the upper surface 21 of the disc body 20, where its luminescence will blend with the light from the LEDs. In a still further alternative embodiment, chemiluminescent material may be blended into the material of the body 20 during manufacture, thus obviating the need for a coating. Such chemiluminescent materials are well-known, and commonly used among toys that are considered "glow-in-the-dark". The materials may be recharged by exposure to bright light; thereafter they slowly loose their luminescence until recharged.

As seen in FIG. 1, a raised center section 40 is mounted on the disc body 20 and defines an interior cavity 48. The raised center section 40 provides an annular sidewall 41 having a lower rim 43 that is mounted on the upper surface 21 of the disc body 20. An upper rim 42 of sidewall 41 supports the perimeter 45 of a generally circular roof 44. The annular sidewall 41 also provides a plurality of holes 46 at spaced intervals through which LEDs are mounted so that they point radially outward, as seen in FIGS. 1 and 2. Each LED is supported by a mounting structure 47, which provides a waterproof means to hold the LED so that it will be visible from the outside of the raised center section.

The raised center section 40 is permanently fused to the disc body 20, as seen in FIG. 1, by means of a seam 49 or other connection means, as is well-known by those in the arts. As a result, interior cavity 48 is totally waterproof.

Figure 5:
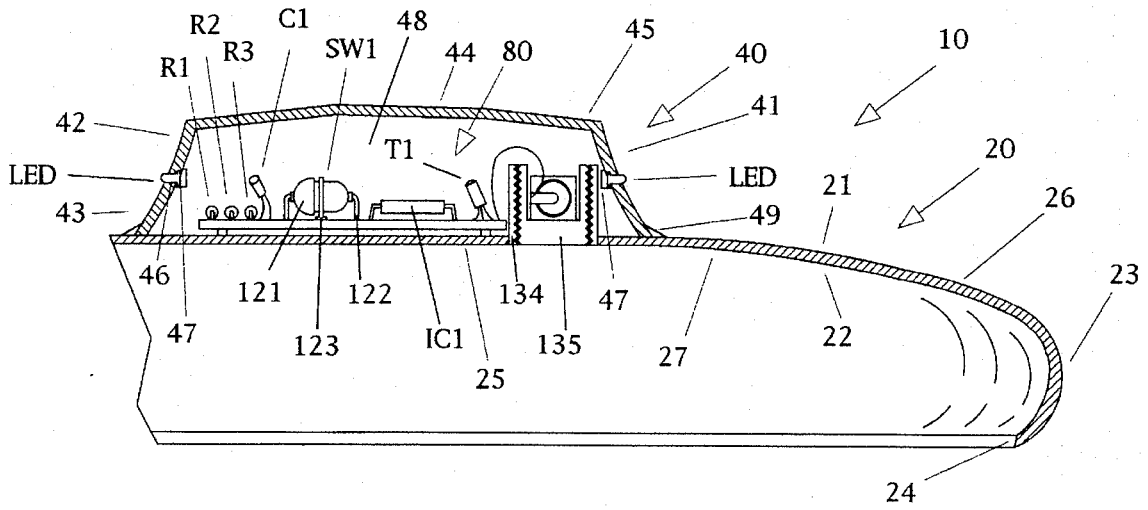
FIG. 5 is a side cross-sectional view of a second version of the flying disc of the invention, showing a battery plug, carrying a battery holder and battery, that is threadedly engaged to the disc body, allowing easy battery replacement.

As seen in FIG. 5, an alternative species allows the user to remove and replace the battery B1. The battery holder 131 with contact arm 132 is carried by a battery plug 133 having a cylindrical body with a threaded exterior. The battery plug may be threaded into a plug receiver 134 that is mounted in the disc body 20.

In the preferred embodiment, the roof 44 and the annular sidewall 41 of the raised center section 40, and the upper surface 21 of the disc body 20 are covered by an ornamental graphical design 60. The design provides portholes 61 and radial striping 62 on the upper surface 21 of the disc body 20. Wedge-shaped radial striping 63 and a center circle 65 are provided on the raised center section. Ornamental LED set-off lines 64 tend to enhance the appearance of the LEDs, which are mounted in the annular sidewall 41 of the raised center section 40. Optionally, words may be written on the disc body 20, as desired.

Figure 4:
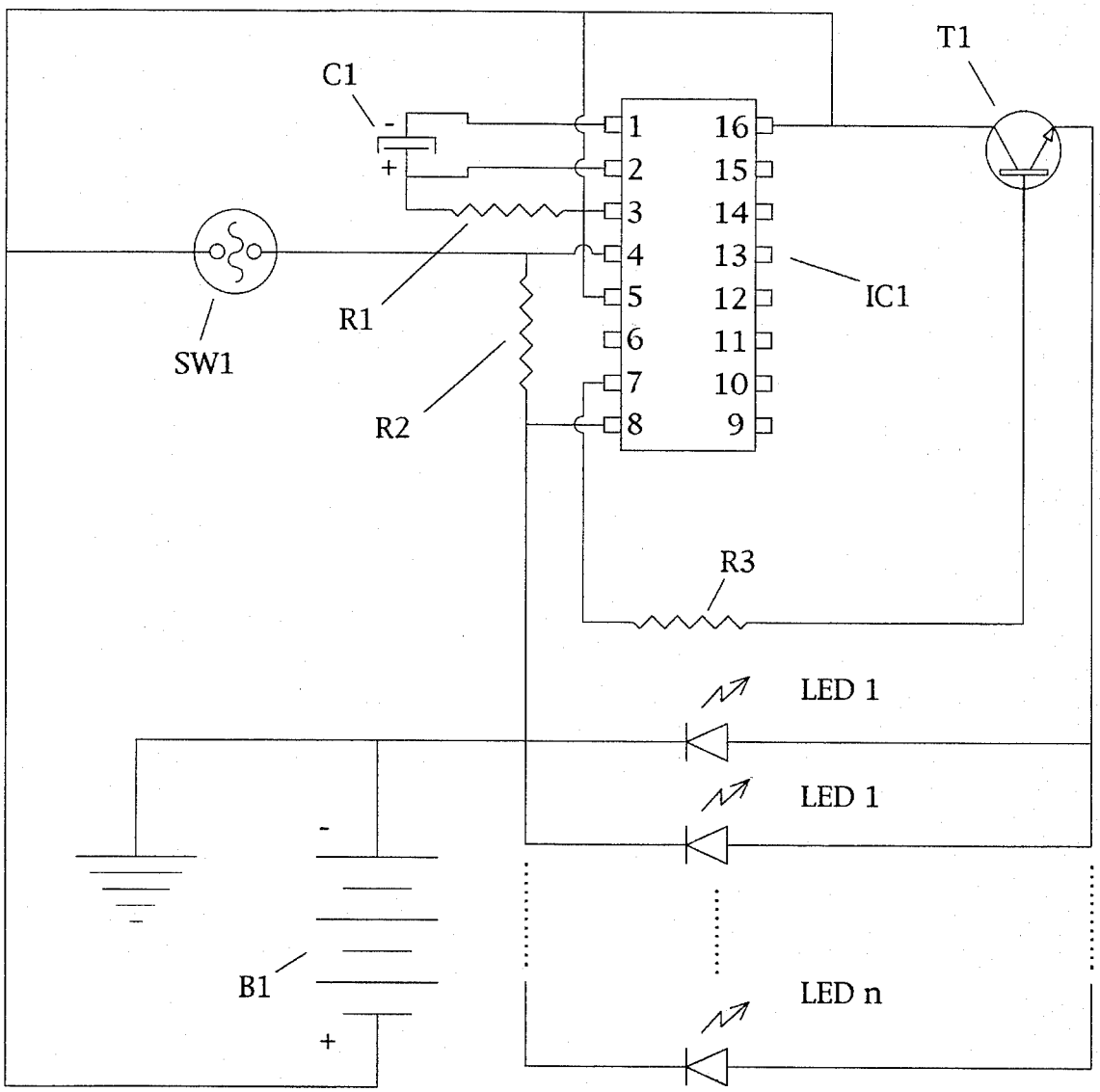
FIG. 4 is an electrical schematic showing one version of the electrical components required to operate the LEDs provided.

As seen in FIG. 4, electronic circuitry controls the operation of the LEDs. U.S. Pat. No. 4,848,009, issued Jul. 18, 1989, to Nicholas A. Rodgers, is incorporated herein by reference. A small circuit board 80 is carried inside interior cavity 48 of the raised center section. The circuit board 80 is supported by legs 81, which rest on the upper surface 21 of the disc body 20. The circuit board carries the necessary components required to operate the LEDs.

The preferred values for the circuit elements are as follows:

IC1: integrated circuit #RR8503 MC14528.

T1: transistor #2N3906.

C1: capacitor 0.47 uF at 30 V.

B1: battery 3 V.

R1, R2, R3: resistor 1 megohm, ⅛ Watt.

A switch SW1, seen in FIGS. 1 and 4, is of a mercury type that is sensitive to motion. A container body 121 encapsulates a mercury globule (not shown). Contact elements 122 extend into the container 121 and may be electronically connected if the mercury globule is physically touching both elements 122. A mounting bracket 123 supports the switch SW1 on the circuit board 80.

Referring to FIG. 4, the operation of the circuitry may be understood. A plurality of LEDs are wired in parallel, and are turned on and off by means of a transistor, T1. The base of transistor T1 is controlled by an integrated circuit, IC1, which is a #RR8503 MC14528 or ECG4098B or similar monostable multivibrator. Input from the switch SW1 causes a voltage transition on pin 4 of IC1, which is otherwise pulled to ground through resistor R2. Pin 5, another input pin, is held high by permanent connection. The voltage transition on pin 4 causes IC1 to go into the "set" condition, causing pin 7 to go to 0 volts, causing transistor T1 to conduct, thereby lighting the LEDs. The "set" condition of IC1 causes a capacitor C1 and a resistor R1, connected between pins 1, 2, and 3 of IC1 to measure a timed period, at the conclusion of which IC1 is returned to the "reset"

condition, causing pin 7 to cause the transistor T1 to turn off current to the LEDs.

The use of the circuitry of FIG. 4 eliminates the need for an on-off switch to conserve power, as it ensures only one momentary illumination of the LEDs per closure of switch SW1. Prolonged closure of the switch SW1 will not drain the battery B1, since each switch closure causes only a brief flash of the LEDs. This allows the flying disc to be held or left where, due to the attitude of the disc, switch SW1 is closed without continuing illumination of the LEDs and consequent depletion of power from battery B1. As a result, in many cases the battery life will exceed one year and replacement of the battery will not be required.

The previously described versions of the present invention have many advantages, including providing a novel flying disc toy having the advantages of both glow-in-the-dark structures as well as LED lighting.

Another advantage of the present invention is to provide an electronic circuit driving the LEDs that turns itself off, and therefore requires no on-off switch.

A still further advantage of the present invention is to provide an electronic circuit driving the LEDs that is responsive to the movement of the disc.

A still further advantage of the present invention is to provide a flying disc toy that provides a raised center portion having a waterproof area that houses the electronic circuitry that is required.

Although the present invention has been described in considerable detail and with reference to certain preferred versions, other versions are possible. For example a large number of similar circuits are known that would perform the functionality disclosed in a similar manner. It would be clear to anyone knowledgeable in the arts that these circuits could be substituted for the circuit described by FIG. 4. Additionally, the circuit components could be encapsulated in a waterproof material, rather than mounted on a circuit card, if desired. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A flying disc toy, comprising:

(a) a substantially disc shaped body terminating at its periphery in a downwardly extending rim, the body and the rim defining a substantially convex upper surface and a substantially concave lower surface;

(b) chemiluminescent means, carried by the body of the disc, for providing illumination;

(c) a raised center section, supported by the upper surface of the body, the center section providing an annular sidewall and a roof, and together with the upper surface of the body, defining an interior cavity that is waterproof;

(d) a plurality of LEDs, mounted at spaced intervals about the annular sidewall of the raised center section; and (e) a circuit board, housed in the interior cavity, comprising:

(a) switch means for making and breaking electrical contact in response to the movement of the flying disc toy;

(b) circuit means for providing a first output signal, upon receipt of an input signal resulting from the closure of the switch means, causing the LEDs to light, and for providing a second output signal, causing the LEDs to turn off a timed period after the receipt of the first input signal;

(c) time selection means, attached to the circuit means, for determining the period of time between the first output signal and the second output signal;

(d) transistor means, connected to the circuit means and to a plurality of LEDs, for receiving the first and second output signals from the circuit means, and for upon receipt of the first signal causing the LEDs to turn on, and for, upon receipt of the second signal, causing the LEDs to turn off; and (e) a battery, carried by a battery holder, connected to the circuit means.

2. The flying disc toy of claim 1, in which the switch means comprises a mercury activation switch, comprising:

(a) a container body;

(b) a mercury globule, carried by the container body;

(c) contact elements extending into the container body; and (d) a mounting bracket, carried by the circuit board, which supports the container body.

3. The flying disc toy of claim 1, in which the circuit means comprises a monostable multivibrator circuit.

4. The flying disc toy of claim 1, in which the timing means comprises:

(a) a resistor, connected to the circuit means; and (b) a capacitor, connected to the circuit means, wherein the values of the resistor and the capacitor are chosen to result in a timed period of approximately one-tenth of a second.

5. The flying disc toy of claim 1, additionally comprising:

(a) a plug receiver, carried by the disc body;

(b) a battery plug, threadedly engageable with the plug receiver.

6. A flying disc toy, comprising:

(a) a substantially disc shaped body terminating at its periphery in a downwardly extending rim, the body and the rim defining a substantially convex upper surface and a substantially concave lower surface;

(b) chemiluminescent means, carried by the concave lower surface of the disc shaped body, for providing illumination; and (c) a raised center section, supported by the upper surface of the body, the center section providing an annular sidewall and a roof, and together with the upper surface of the body, defining an interior cavity that is waterproof; and (d) a plurality of LEDs, mounted at spaced intervals about the annular sidewall of the raised center section; and (e) a circuit board, housed in the interior cavity, comprising:

(a) switch means for making and breaking electrical contact in response to the movement of the flying disc toy, comprising:

(a) a container body;

(b) a mercury globule, carried by the container body;

(c) contact elements extending into the container body; and (d) a mounting bracket, carried by the circuit board, which supports the container body;

(b) circuit means, comprising a monostable multivibrator circuit, for providing a first output signal, upon receipt of an input signal resulting from the closure of the switch means, causing the LEDs to light, and for providing a second output signal, causing the LEDs to turn off a timed period after the receipt of the first input signal;

(c) time selection means, attached to the circuit means, for determining the period of time between the first output signal and the second output signal, comprising:

(a) a resistor, connected to the circuit means; and (b) a capacitor, connected to the circuit means, wherein the values of the resistor and the capacitor are chosen to result in a timed period of approximately one-tenth of a second;

(d) transistor means, connected to the circuit means and to a plurality of LEDs, for receiving the first and second output signals from the circuit means, and for upon receipt of the first signal causing the LEDs to turn on, and for, upon receipt of the second signal, causing the LEDs to turn off; and (e) a battery, carried by a battery holder, connected to the circuit means.

7. The flying disc toy of claim 6, additionally comprising:

(a) a plug receiver, carried by the disc body;

(b) a battery plug, threadedly engageable with the plug receiver.

* * * * *